United States Patent [19]

Kühn

[11] Patent Number: 4,879,885

[45] Date of Patent: Nov. 14, 1989

[54] KNITTING MACHINE HAVING RELATIVELY ADJUSTABLE NEEDLE CAMS AND SINKER CAMS

[75] Inventor: Falk Kühn, Rottenburg, Fed. Rep. of Germany

[73] Assignee: Memminger GmbH, Freudenstadt, Fed. Rep. of Germany

[21] Appl. No.: 190,033

[22] Filed: May 4, 1988

[30] Foreign Application Priority Data

May 19, 1987 [DE] Fed. Rep. of Germany ..... 3716711

[51] Int. Cl.[4] ..... D04B 15/24; D04B 15/32

[52] U.S. Cl. ..... 66/54; 66/104

[58] Field of Search ..... 66/27, 54, 90, 104, 66/107

[56] References Cited

U.S. PATENT DOCUMENTS

| | | | |
|---|---|---|---|
| 2,090,500 | 8/1937 | Lawson | 66/107 |
| 3,934,431 | 1/1976 | Westmoreland, Sr. | 66/90 |
| 4,532,781 | 8/1985 | Buck | 66/104 |
| 4,550,577 | 11/1985 | Kühn | 66/104 |
| 4,608,841 | 9/1986 | Buck | 66/104 |
| 4,633,684 | 1/1987 | Kühn | 66/104 |

FOREIGN PATENT DOCUMENTS

| | | | |
|---|---|---|---|
| 2408924 | 8/1975 | Fed. Rep. of Germany . | |
| 2819072 | 11/1978 | Fed. Rep. of Germany | 66/54 |
| 3108041 | 9/1982 | Fed. Rep. of Germany . | |
| 3247767 | 7/1984 | Fed. Rep. of Germany . | |
| 3433290 | 3/1986 | Fed. Rep. of Germany . | |
| 224889 | 7/1985 | German Democratic Rep. . | |
| 2030890 | 7/1980 | United Kingdom | 66/107 |
| 2158106 | 11/1985 | United Kingdom | 66/104 |

*Primary Examiner*—Wm. Carter Reynolds

*Attorney, Agent, or Firm*—Frishauf, Holtz, Goodman & Woodward

[57] ABSTRACT

A knitting machine has at least one needle bed (1), which is equipped with needles (4) that are controlled by needle cam parts, (16), following along a needle control curve, and are guided longitudinally. Between the needles, sinkers (22) that are short in comparison with their length are supported on the needle bed, or on a sinker carrier (21) connected to it, such that they can be displaced in the longitudinal direction of the needles and essentially transversely to it, about a transverse axis. The longitudinal and transverse movements of the sinkers are controlled, in each case following along a sinker control curve, such that during at least part of the withdrawal movement of the needles, which is devoted to loop formation, they execute a projection movement contrary to this withdrawal movement. To enable changing the loop length easily, a needle cam carrier (14) carrying the needle cam parts (16) and a sinker cam carrier (12) carrying the sinker cam parts (30, 36, 37) are adjustable relative to one another, transversely to the needle longitudinal direction. The needle cam control track, and the sinker cam control track associated with the sinker longitudinal movement, have portions that are essentially aligned in the same direction.

11 Claims, 6 Drawing Sheets

FIG.5
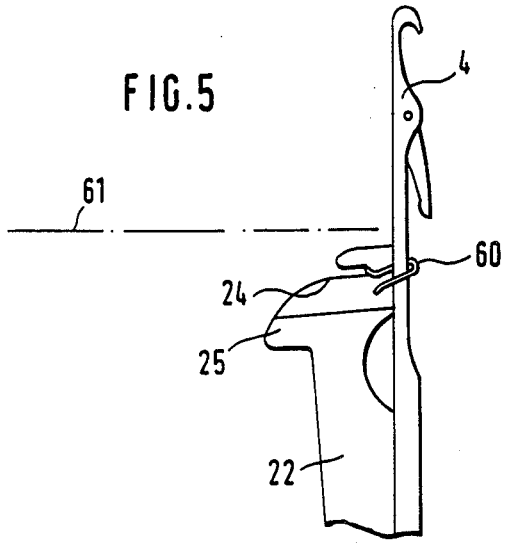
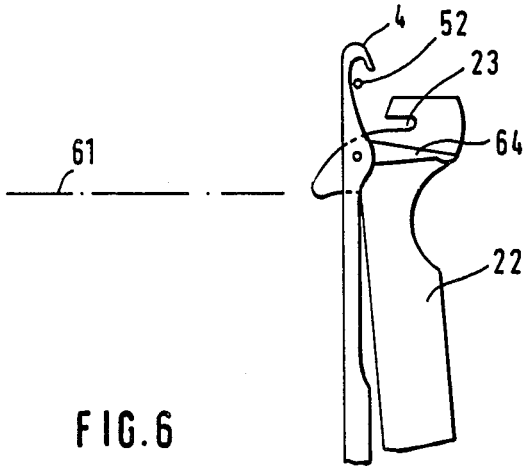
FIG.6

KNITTING MACHINE HAVING RELATIVELY ADJUSTABLE NEEDLE CAMS AND SINKER CAMS

Reference to related patents, both assigned to the assignee of the present invention, and the disclosures of which are hereby incorporated by reference: U.S. Pat. No. 4,608,841 (corresp. to German DE-PS No. 33 30 530), U.S. Pat. No. 4,633,684 (corresp. to German DE-PS No. 35 10 054).

Reference to related publications: German Patent Nos. 33 30 530 (corresp. to U.S. Pat. No. 4,608,841), 35 10 054 (corresp. to U.S. Pat. No. 4,633,684), 34 33 290. U.S. Pat. No. 3,837,185. German Democratic Republic (East German) No. 224,889.

The present invention relates to knitting machines, and more particularly to knitting machines having at least one needle bed on which needles and sinkers are located, and on which needle cam elements and sinker cam track elements are retained such that the respective needle cam control tracks and sinker cam control tracks can be relatively adjusted.

BACKGROUND

Knitting machines having sinkers which, relative to the needles, are quite short and located between the needles, are known. The movement of the needles and of the sinkers, respectively, is controlled by the needle cams and sinker cams. The sinkers are located to be longitudinally movable and, additionally, to be pivotable about an axis transverse to the longitudinal extent of the needles. During some portions of the needle movements, the sinkers move counter to the direction of the needles. To permit adjustment of the machines, it is also known to so construct the cam parts carrying the needle and sinker cams, respectively, that they can be adjusted with respect to each other. Such adjustment may permit change of the length of the stitches or loops being knitted, and thus changing the characteristics and/or the quality of the fabric which is being made.

Such knitting machines, such as are known in a specialized form from U.S. Pat. No. 4,608,841, Buck, to which German Patent No. DE-PS 33 30 530 corresponds, make it possible, because of the counter-directed movement of the needles and sinkers, to use relatively short needle movements and hence quite flat needle and sinker cam control tracks, which allows a substantial increase in the knitting speed as compared with knitting machines in which the needles, in the usual manner, execute a long stroke with respect to a fixed casting-off ridge. In order to avoid abrupt changes in motion of the needles and sinkers, the needle and sinker cam control tracks can also be embodied as substantially sinusoidal, as is described in U.S. Pat. No. 4,633,684, Kuhn, to which detail in German Patent No. DE-PS 35 10 054 corresponds.

In these knitting machines operating with contrary needle and sinker movement, it is generally true that a complete knit stitch or loop can be formed in a region of the needle cam control track extending over only one needle cut, and as a consequence the yarn can be handled very gently during loop formation. Because of the short needle and sinker movements, these machines also permit a relatively high density of feeds, which means that 120 or more feeds can be accommodated on the 30-inch-diameter needle cylinder of a circular knitting machine of this kind.

In practice, the need often arises of changing the loop length, or in other words the tightness of the goods, as needed. In such machines with numerous feeds, this conversion often entails a considerable expenditure of time, which is considered a disadvantage.

It's also known to prove, in a knitting machine, having oppositely directed needle and sinker movement. This machine provides for a central loop adjustment for all knitting feeds. The cam parts for the sinkers and the cam parts for the latch needles are located on separate cam carriers, which are adjustable both in the longitudinal direction of motion of the sinkers and needles and transversely thereto. Additionally, the cam parts for the sinkers and/or the latch needles have knock-over cam parts adjustable in a known manner with respect to the cam carriers, the cam part arrangement being such that the needle movement curve and the sinker movement curve, at the end of the portions of their movement counter to one another, can have loop forming points, or positions that match one another in the forward direction. The mutual adjustability of the needle and sinker cam carrier, both in the longitudinal direction of motion of the sinkers and needles and transversely thereto, requires two separate adjustment apparatuses and hence a considerable expense for construction (see German Patent Disclosure No. DE-OS 34 33 290). Less expense for the central loop adjustment is obtained in a multi-feed circular knitting machine known from British Patent No. 2,158,106, to which East German Patent No. DD-PS 224 889 corresponds. In this machine, for loop adjustment either a sinker cam ring is rotated in the circumferential direction relative to the stationary cylinder cam, or conversely the cylinder cam is rotated relative to the stationary sinker cam. The cylinder cam and the sinker cam are located on separate cam carriers, so that complicated adjusting gears and the like can be dispensed with.

The cam parts for the needles and sinkers are embodied such that the travel distance necessary for forming a loop is covered partly by the yarn-carrying needles and for the remainder by the sinkers; after attaining the loop forming position, the sinkers along with the needles are moved downward in the same direction to initiate the stitch or loop transfer. The arrangement is such that at each feed, the rising slope of the sinker cam track or cam control track, formed of identical portions, is selected to be steeper after reaching the loop forming position than the portion, aligned in the same direction, of the needle cam track or cam control track, while the rising slope of the singer cam track or cam control track, in the vicinity of the maximum needle projection during knitting or yarn seizing, is approximately equal to zero over approximately one-ninth to one-seventh the width of one feed. The sinker cam track or cam control track and/or the needle cam track or cam control track is displaceable, per feed and/or in its entirety, in the circumferential direction by a distance that is equivalent to approximately one-ninth to one-seventh the width of one feed.

Although the tightness of the goods can be changed rapidly as needed by simple means in this circular knitting machine, nevertheless disadvantages in terms of loop or stitch formation, resulting from the specialized shape of the needle and sinker cam curves or cam control tracks, must be accepted into the bargain.

Finally, U.S. Pat. No. 3,837,185 also discloses a circular knitting machine in which relatively long sinkers cooperate with the needles, the needles being movable axially parallel and aligned lengthwise on the needle cylinder, and the sinkers being movable obliquely to the needles and pointing radially outward from them and supported displaceably in a sinker ring. In this knitting machine, once the needles reach their lowermost reversal point, equivalent to the lowest draw-off position, they are initially moved upward together with the sinkers, in the course of which, because of their oblique position, they increasingly seize the yarn forming the new loop. Aside form the difficulty of overseeing the entire machine because of the oblique arrangement of the sinkers and the necessarily resulting invariable mutual dependency of the longitudinal and transverse motion of the sinkers on one another, this knitting machine has no possible means for changing the tightness of the goods.

The Invention

It is an object to provide a knitting machine construction and arrangement in which the length of the stitches or loops can be easily adjusted with minimum mechanical constructional elements, so that the characteristics and/or tightness of the woven fabric can be controlled, and in which, preferably, all knitting feeds of the knitting machines can be adjusted or knitting feeds of the knitting machines can be adjusted or controlled simultaneously while retaining excellent conditions for stitch or loop transfer and fabric formation.

Briefly, the needle cam control track is positioned with respect to the sinker cam control track such that, in a first range of movement of the needles and the sinkers, movement of the needles is controlled in a direction downwardly towards the lowest needle withdrawn or needle movement reversal position. At this point, movement is counter to the direction of concurrent movement of the sinkers. This determines the length of the knitted stitches. An adjacent second range of the movement of the needles and sinkers is then controlled by the cam tracks from a position in which the needles are at their lowest or withdrawn position by the sinker cam track being essentially in alignment with the lowest withdrawn position of the needle cam track. Thus, the needle cam track has its lowest, withdrawn or change-of-direction position at a portion of the sinker cam track which controls the sinker already for projecting movement. A third range of movement of the needles and sinkers is controlled by the respective ban tracks such that the needles and sinkers move in the same direction. The needle cam control track and the sinker cam control track, in the third range, have rising portions. The needle cam control track follows the lowest or withdrawn position. The rising portions of the needle and sinker control tracks extend over a predetermined section or range in which the needle cam control track is essentially parallel to the sinker cam control track. The track need not be exactly parallel, but may be relatively curved or convergent. Adjustment elements are provided for the sinker cam structure as well as for the needle cam structure to permit relative positioning of the needle cam structure and the sinker cam structure to place all the needle control tracks and the sinker control tracks such that the lowest withdrawn and direction reversal position of the needle cam track remains always in alignment with the sinker cam control track, in its rising portion, and with projection movement of the sinkers. The adjustment is so arranged that the separation of the essentially parallel relative position of the needle cam track and the sinker cam track is retained.

The arrangement has the advantage that, thereby, central repositioning of, respectively, the needle and sinker control elements relative to each other, permits changing the length of the stitches or loops at all knitting feeds; it is only necessary to move one of the two cam structures transverse to the longitudinal direction of the needles. The conditions of formation of the stitches or loops in the region of the loop transfer does not change even upon such adjustment. The yarn is handled, throughout stitching, in an especially gentle manner.

In a preferred embodiment, the needle control track and/or the sinker control track is each gently curved in the vicinity of the direction reversal points. While the needles and sinkers, on forming the new loop, thus execute contrary movements, once the particular loop length set at a given time has been attained the needles are made to follow the sinker movement, by a gentle reversal of movement direction. THE corresponding ranges of movement in the same direction of the needle and sinker cam control tracks can be essentially straight, so that the needle and sinker projection angles in these portions are essentially constant.

For the loop formation process it has proved to be advantageous for the portions of the needle and sinker cam control track running in the same direction to extend over at least two needle cuts, so that at least two fully formed loops are present before the needle control cam and the sinker control cam again diverge from one another. In this connection, it should be noted that the terms "aligned in the same direction", or "essentially in the same direction", referring to portions of the path of movement also include arrangements of the needle and sinker cam track in which these curves in these portion converge slightly, so as to relieve the tension on the newly formed loops thereby.

Drawings showing an exemplary embodiment:

Figure 2A:
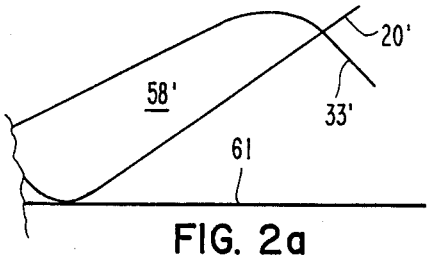
FIGS. 2–4 are a detail of the needle and sinker control curve of the circular knitting machine of FIG. 1, showing a knitting feed with three different loop length settings.
Figure 1:
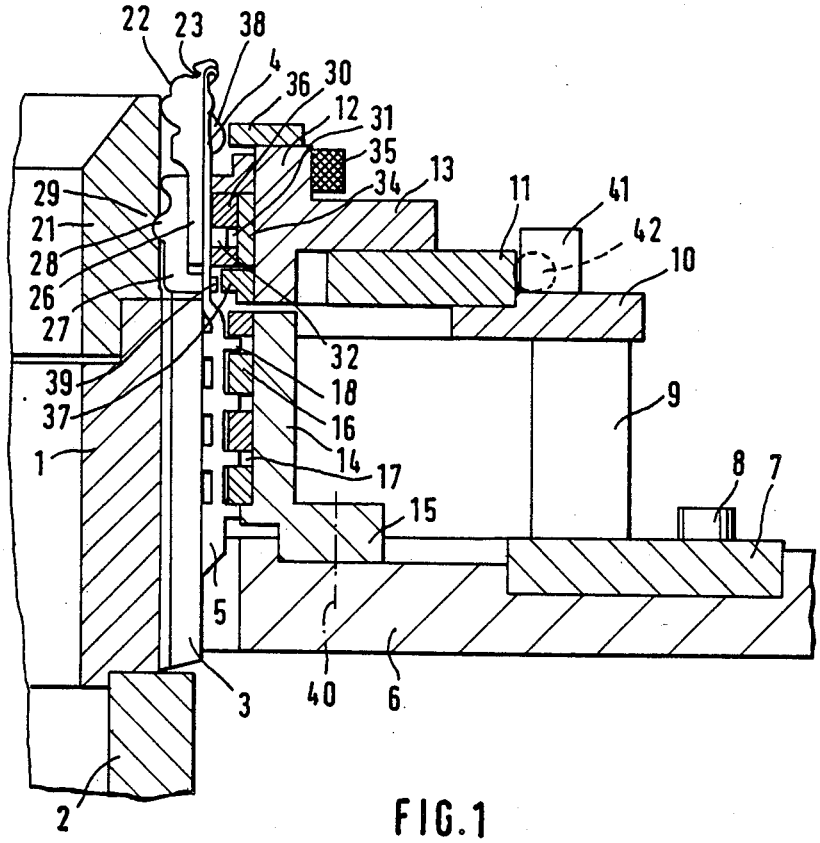
FIG. 1 is an axial section through the needle cylinder and the associated cam carrier of a circular knitting machine according to the invention, seen in a fragmentary representation and in a side view.
Figure 2:
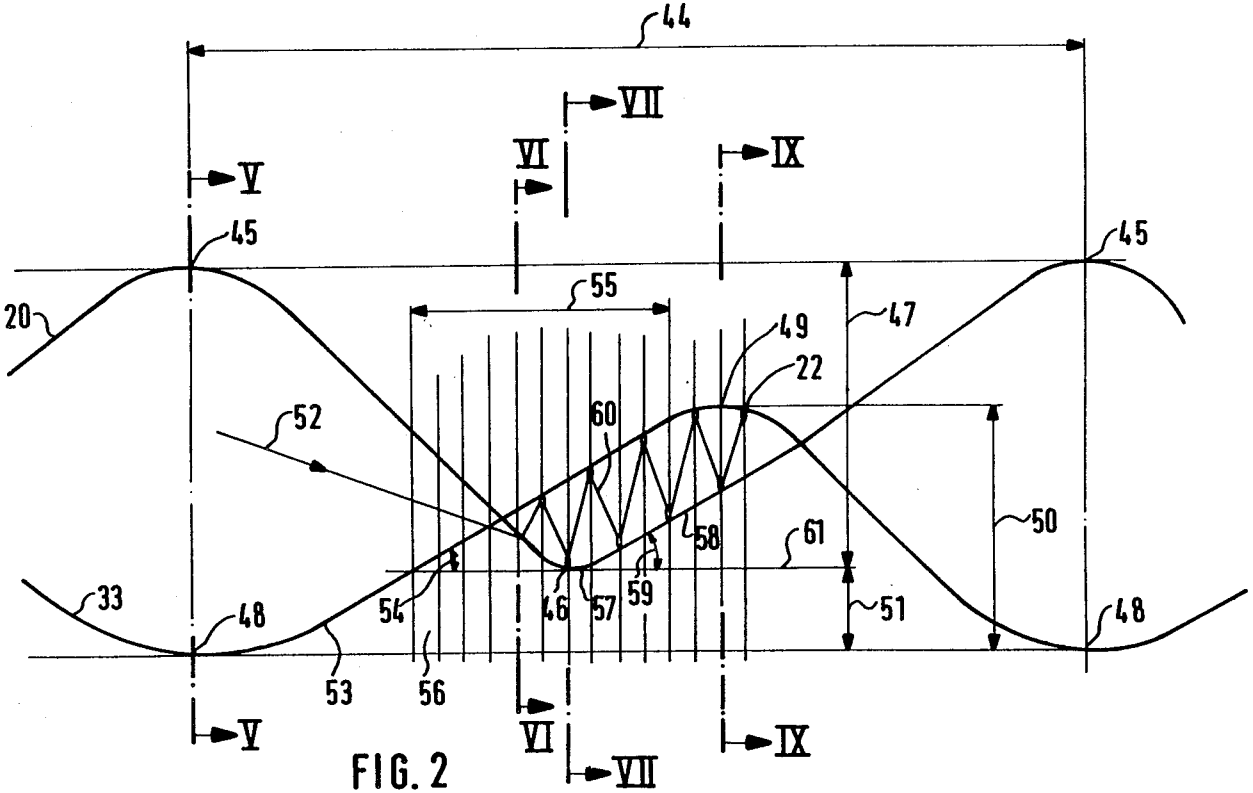
Figure 8:
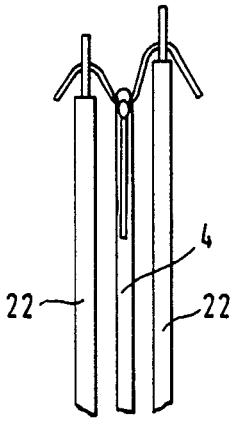
Figure 7:
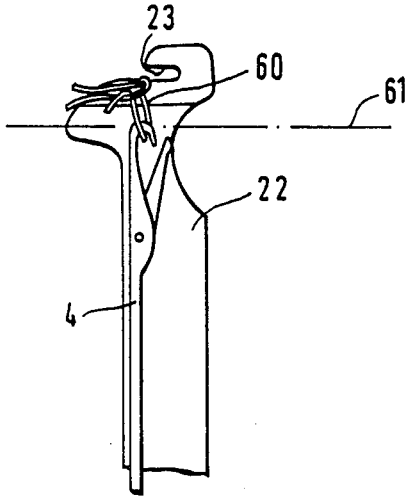
Figure 10:
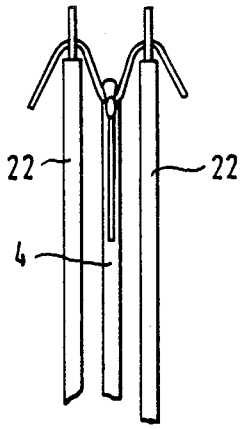
Figure 9:
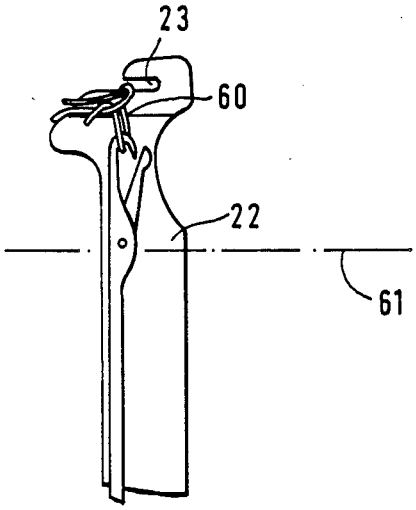

FIG. 2*a* is a fragmentary schematic view of modified cam track portions;

FIGS. 5, 6, 7 and 9, in a side detail view, show a needle and an adjacent sinker of the circular knitting machine of FIG. 1, respectively showing sections taken along the line V—V, VI—VI, VII—VII and IX—IX, of the needle and sinker control curve of FIG. 2; and FIGS. 8 and 10, respectively, show the arrangement of FIG. 7 and FIG. 9 in a view from the front, showing two sinkers adjacent the needles, and showing the course taken by the yarn.

DETAILED DESCRIPTION

FIG. 1 shows only those parts of a circular knitting machine, otherwise having a known construction, that pertain to the knitting head and are essential to understanding the invention.

The needle cylinder 1, rotating about its vertical axis, is rigidly connected to a coaxial driver ring 2. On its outer circumferential face, the driver ring is equipped with spaced-apart parallel needle ribs 3, between which latch needles 4 are longitudinally displaceably guided with their needle shanks 5.

Surrounding the needle cylinder 1 at a radial distance is a stationary cam carrier ring 6, on which a coaxial ring plate 7 is rotatably supported, which is screwed to the cam carrier ring 6 in its position at a given time by means of screw bolts 8. The ring plate 7 has support posts 9, distributed evenly in a ring about the circumference of the needle cylinder 1 and on which a receiving ring 10 that is coaxial with the needle cylinder 1 is secured. A likewise coaxial intermediate ring 11 is supported on the receiving ring 10 and on it, in turn, is supported a sinker ring 12, divided into segments and having a ring flange 13.

Below the sinker ring 12, a needle cam jack 14 coaxial with it is provided, which is supported on the cam carrier ring 6 by means of a ring flange 15. Secured on the needle cam jacket 14 on the side oriented toward the needle cylinder 1 are needle cam parts 16, which define needle cam tracks 17 engaged by the latch needles 4 in a manner known per se, with control butts 18 formed onto their shank 5. The needle cam parts 16 are so formed such that the needle cam tracks 17 are each defined by one needle control track, shown in FIG. 2–4 at reference numeral 20.

A coaxial sinker cylinder 21 is mounted on the needle cylinder 1 such as to rotate with the needle cylinder 1, and axially parallel sinkers 22 are located between the latch needles 4 on the outside circumferential surface of the sinker cylinder 21. Each of the sinkers 22 has a sinker head 25 which includes a throat 23 and a knock-over edge 24 (see FIGS. 5, 6). Each sinker has a shank 26 it is supported longitudinally displaceably, (see FIG. 1), on an essentially L-shaped pivot lever 27, which in turn is pivotably supported about a horizontal pivot axis by a pivot projection or dog 28, fitted in a corresponding indentation 29 on the circumference of the sinker cylinder 21.

Figure 3:
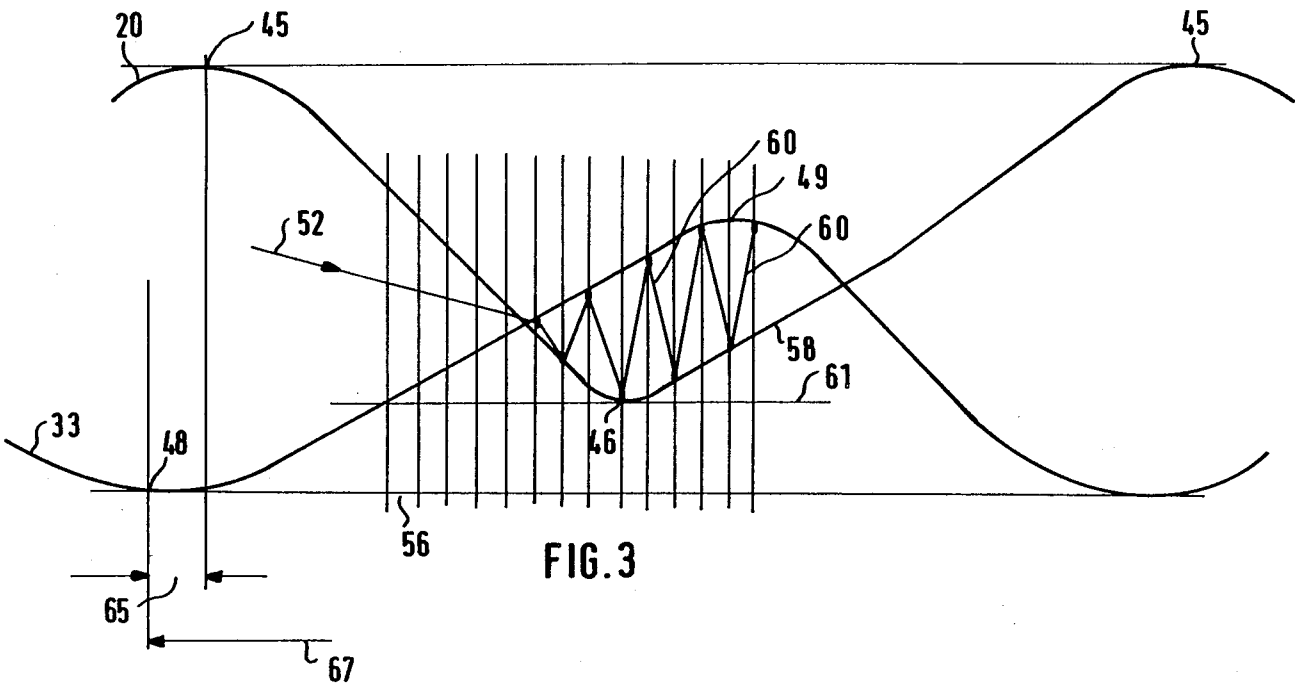
Figure 4:
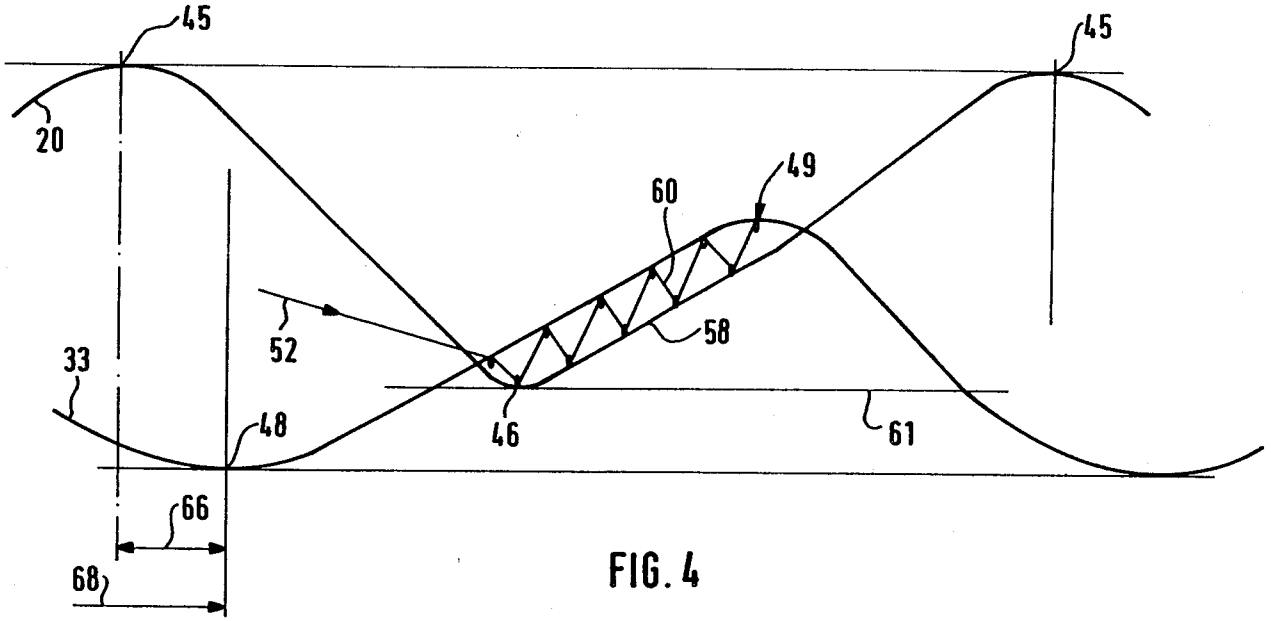

Sinker cam parts 30 located on the side of the sinker ring 12 oriented toward the sinker cylinder 21 define a sinker cam track 31, engaged by each of the sinkers 22 with a control butt 32, and defined by a sinker control track 33 (see FIGS. 2–4). The sinker cam parts 30 thus lend the sinkers 22 a longitudinal movement in the same direction as the longitudinal movement of the needles 4, along the sinker control track 33. The sinker cam parts are connected to the sinker ring 12 at each knitting feed via a carrier element 34, which is part of an adjusting mechanism that has a set screw having a knurled head 35 and which makes it possible to adjust the sinker cam parts 30 at each feed individually in the needle longitudinal direction with respect to the sinker ring 12.

Two further sinker cam parts 36, 37 are secured to the sinker ring 12 on both sides of the sinker cam parts 30, cooperating with control projection or dog 38, of the sinkers 22 and projection 39 of the pivot lever 27 and controlling the sinkers 22 directly or on the pivot level 27 to have a pivoting motion about the horizontal axis defined by the indentation 29.

The details of the supporting and guiding of the latch needles 4 and sinkers 22 as well as their embodiment, including the embodiment of the mechanism for adjusting the sinker cam parts 30, are described for example in German Patent No. DE-PS 33 30 530, which is hereby incorporated by reference, on the proviso that the sinkers 22 need not necessarily have the two-part embodiment with the pivot lever 27 shown in FIG. 1 and described in this reference; instead, one-piece sinkers can also be used, such as are also described in this patent reference. The sinkers 22 are in any case, however, short as compared with the length of the latch needles 4, and both in their longitudinal motion and in their pivoting motion directed transversely to the latch needles 4 are controlled by separate sinker cam parts 30 and 36, 37, respectively.

In contrast, to the situation in the circular knitting machine known from the aforementioned patent, in the present case the needle cam parts 16 and the sinker cam parts 30 are located on separate cam carrier, which are formed by the needle cam jacket 14 and the sinker ring 12. The arrangement is such that the needle cam jacket 14 and the sinker ring 12 are rotatable to a limited extent with respect to one another in the circumferential direction, or in other words transversely to the latch needles 4. To this end, the needle cam jacket 14 may be firmly screwed to the cam carrier ring 6, as indicated at 40 in FIG. 1, while the ring flange 13 of the sinker ring 12 is rotatable to a limited extent with respect to the intermediate ring 11, or the intermediate ring 11 is rotatably to a limited extent with respect to the receiving ring 10, and are fixable in a given angular position once it has been set. Alternatively, the needle cam jacket 14 can be supported such that it is limitedly rotatable on the cam carrier ring 6, while the sinker 12, via the ring flange 13 and both the intermediate ring 11 and the receiving ring 10, is screwed such as to be fixed against relative rotation to the ring plate 7 and hence to the cam carrier ring 6.

For the sake of simplicity, in the presence case it is assumed that the needle cam jacket 14 is firmly screwed to the cam carrier ring 6 and the intermediate ring 11 rigidly connected to the ring flange 13 is rotatable with respect to the receiving ring 10, and to this end an adjusting worm 42 that is rotatably supported on a bearing element 41 of the receiving ring 10 is provided, which meshes with a corresponding worm gear at the circumference of the intermediate ring 11 and can be adjusted by hand.

Finally, in connection with FIG. 1, it should be noted that the sinker cylinder 21 may also directly be a formed-on part of the needle cylinder 1, thereby providing a one-piece construction in this respect.

The needle and sinker control curve 20 and 33, respectively, shown in FIGS. 2–4, in each case over one feed length 44, each have an approximately sinusoidal course with gently curved, arc-like transitional regions at the points of reversal of movement. The upper movement reversal points of the needle cam control track 20, at which the latch needles 4 assume their fully projected position, are shown at 45; the lower motion reversal point, which defines the lowest withdrawn needle position, that is, at which the latch needles 4 are located in their lowermost withdrawn position, is located at 46. The needle stroke, that is, the maximum travel of the latch needles 4, is equal to the distance 47 in FIG. 2. It is equal to or shorter than the latch motion length of the latch needles 4.

The sinker cam control track 33 associated with the longitudinal movement of the sinkers 22 has two lower movement reversal points 48, at which the sinkers 22 have each assumed their lowermost withdrawn position. Between these two points, the sinkers 22 attain an upper movement reversal point at 498, at which they are projected to the greatest extent.

The sinker stroke 50 is shorter than the needle stroke 47 and hence shorter than the latch motion. The excess stroke 51 of the sinkers 22 assures that despite the needle stroke 47, which is equal to (or less than) only the latch motion length of the latch needles 4, secure holding-down of the loop in the needle takes place.

In FIG. 2, the needle cam control track 20 and the sinker cam control track 33 for a mutual adjustment of the needle cam jacket 14 and sinker ring 12 is shown, in which the upper motion reversal points 45 of the needle cam control track 20 and the lower motion reversal points 48 of the sinker cam control track 33 are located vertically precisely one above the other. This setting is equivalent to a medium loop length; beginning at this "outset position", a longer or shorter loop length can be selectively set by corresponding rotation of the sinker ring 12 with respect to the needle cam jacket 14, as shown in FIGS. 3, 4 and as described hereinafter.

Needle and sinker movement, with reference to FIG. 2: Beginning at their fully projected position at 45, the latch needles 4, with their needle hooks, follow the needle cam control track 20, initially in a lowermost portion of the cam truck executing a withdrawal movement, in the course of which, upon attaining the section line VI—VI, they seize the arriving yarn 52. During this drawing-off movement of the latch needles 4, the sinkers 22 execute a contrary or oppositely directed longitudinal movement, beginning at the lower motion reversal point or position 48, and then, at the gently curved arcs 53, in the vicinity of the lower motion reversal point 48, beyond the loop formation range the sinkers are projected with a constant projection angle 54 at a rising portion of the sinker cam. This means that the sinker cam control track 33 is essentially straight approximately over a rising region or portion 55 extending over a range of five needle cuts (indicated at 56) in the rising section of the track. The lower motion reversal point or position 46 of the needle cam control track 20, which determines the loop forming or lowermost withdrawn needle position is located inside this portion 55 of the sinker cam control track 34 that controls the sinkers 22 for projection. At this portion 55, with a transition via a gently curved arc portion 57, the needle cam control track 20 has an essentially straight rising portion 58 in the rising section of the track 20. This portion 58 is essentially parallel or in other words aligned in the same direction to the straight portion or section of the sinker cam control track 33 located in portion 55; once again a constant needle projection angle, shown at 59, is associated with this essentially straight portion 58 in the rising section of the needle cam track 20. In the range extending in FIG. 2 over approximately five needle cuts, in which the needle cam control track 20 and the sinker cam control track 33 are essentially straight and oriented in the same direction, the latch needles 4 thus follow the projection movements of the sinkers 22, so that the length of the loops 60 remains constant.

After passage through the portion 55, the sinkers 22 proceed along the sinker cam control track 33 in a gentle arc to their upper motion reversal point 49, which is still located within range of the portion 58 of the needle cam control track 20 controlling the latch needles for projection; this means that the sinkers 22, with a continued projection motion of the latch needles 4, now execute a drawing-off motion, until they reach the lower motion reversal point 48. The portion 58 controlling the projection motion of the latch needles 58, in turn, continues until the upper motion reversal point 45 is attained, whereupon the latch needles are in the fully projected position and can again seize the yarn 52.

The contrary motion of the latch needles 4 and sinkers 22 as they pass through the above-described portions of the needle and sinker cam control tracks 20 and 33 is shown in FIGS. 5–10, in typical positions taken along the section lines V—V, VI—VI, VII—VII and IX—IX of FIG. 2, as follows:

In FIG. 5, the latch needles 4 and the sinkers 22 adjacent them are each in the dead center position corresponding to the respective motion reversal points 45 and 48. The dot-dash line 61 represents the line passing through the lower motion reversal point 48 of the needle cam control track 20 (see FIG. 2). The latch needle 4 is projected upward to the maximum extent; the sinker 22 has executed its drawing off motion downward, shortly after it had beforehand concluded a radially inwardly directed movement in the course of which the loop 60 was seized in the throat 23.

In the position shown in FIG. 6, that is, VI—VI of FIG. 2, the latch needle 4 is already withdrawn quite far, while the sinker 22 has executed a longitudinal projection movement contrary to the latch movement, at the same time having moved radially outward with its throat 23 by comparison with FIG. 5. The latch needle 4 has seized the yarn 52, while the latch 64 is just at this time ready to be closed over the loop, not shown in further detail, hanging on the needle shank.

In FIGS. 7 and 8, the positions (VII—VII) is shown in which the latch needle 4 has attained its loop formation or lowermost withdrawn position corresponding to the lower motion reversal point 46 of FIG. 2. The two sinkers 22 adjacent to the latch needle 4 are projected farther as compared with the position of FIG. 6, and the distance between the needle hook and the casting-off edge 24 of the farther-projected sinker 22 shown on the ring in FIG. 8 corresponds with the loop length that has been set.

While maintaining this mutual three-dimensional association shown in FIGS. 7 and 8, the latch needles 4 and the adjacent sinkers 22 are now projected farther together, until the sinkers 22 each enter their upper motion reversal point 49 (FIG. 2), resulting in the position shown in FIGS. 9, 10 (that is IX—IX of FIG. 2). In this view, associated with the reversal of motion of the sinkers, it is apparent that the now completely formed loops 60 are straightened, which is particularly important in order to attain loop sides of equal length. In the course of their loop or stitch stepping-off motion, the sinkers 22 are moved radially inward, so that they seize the loop 60 in their throat 23 and carry it downward with them, while the latch needle 4 continues its projection movement until it reaches the upper motion reversal point 45 and the position shown in FIG. 5.

Changing the stitch lengths: In order to change the length of the loops 60 formed in this manner described above, the sinker ring 12 is rotated with respect to the needle cam jacket 14, as already mentioned, by a desired angular value which corresponds to an equivalent mutual horizontal displacement of the needle and sinker cam control tracks 20 and 23, respectively, which is shown at 65 and 66, respectively, in FIGS. 3, 4.

Increasing stitch size, FIG. 3: Beginning at the mutual association of the needle and sinker cam control tracks 20 and 33 of FIG. 2, which correspond to an average loop length, FIG. 3 shows the sinker cam control track 33 displaced displaced by approximately 2 needle cuts to the left with respect to the needle cam control track 20, as indicated by an arrow 67. The distance between the parts aligned in the same direction of the needle and sinker cam control tracks 20 and 33, respectively, measured in the needle longitudinal direction, thus becomes greater, so that the loop length also becomes correspondingly greater. The aligned in the same direction located between the motion reversal points 46 and 49 should, as shown in FIG. 3, extend over a range of at two needle cuts.

Decreasing stitch size, FIG. 4: In FIG. 4, the sinker cam control track 33 is displaced to the right in the direction of an arrow 68 by an amount 66 corresponding to approximately four needle cuts with respect to the needle cam control track 20. The vertical spacing, measured in the needle longitudinal direction, between the aligned (in the same direction) curve portions (58) has thus become shorter; hence a short loop length is set.

A comparison of FIGS. 2, 3 and 4 shows that despite the mutual displacement of the needle and sinker cam control tracks 20 and 22, the loop forming conditions in the loop forming region, that is in the formation of a new loop by the latch needle 4 entering its loop forming position at 46, have remained entirely the same, which is equally true for the curve sections aligned in the same direction (at 58) immediately adjacent the loop forming position, in which portions the finished loop is left unchanged over at least two needle cuts.

The knitting process described can be performed with the same needle and sinker cam control tracks 20, 33 with compound needles as well, which is mentioned for the sake of completeness. FIG. 2a shows the needle and sinker cam control tracks 20', 33', in the portions 58' essentially aligned in the same direction, as converging with one another, to attain a relief of tension on the finished loops 60.

Finally, embodiments are also possible in which the needle and sinker cam control tracks 20, 33 or 20', 33' in the portions 58, 58' aligned in the same direction are not straight but instead are curved with respect to one another accordingly, for example as shown schematically by track 33'.

The adjusting screw and head 35 (see FIG. 1) makes it possible, to provide for optimal adjustment of the loop length and of the loop forming conditions at the individual feeds, by vertical adjustment of the loop forming cam parts of the sinker cam parts 30 that control the longitudinal movement of the sinkers 22. In principle, this changes nothing of the mutual relationship of the needle and sinker cam control tracks 20 and 33 as shown in FIGS. 2-4. The maximum sinker movement, or in other words the sinker stroke 50 (see FIG. 2) is always constant for one complete quality range of goods.

The curve portions 58, shown in FIG. 2 as completely aligned in the same direction, and in the portion 55 may, as already mentioned earlier (FIG. 2a) also be set to converge slightly, the extent of convergence depending on the stretching properties of a yarn, for example a reinforced yarn. The convergence can be changed by means of a slight adjustment of the corresponding needle and/or sinker cam parts in accordance with any suitable and well known adjustment arrangement.

The sinker cam control track, with its upper motion reversal point following the predetermined portion that is essentially aligned in the same direction to the needle curve, the sinker cam control track is suitably still located in the vicinity of the part of the needle control curve that controls the needles for projection, such that the sinkers, with an initially still-continued projection movement of the needles, execute a drawing-off movement.

The range of adjustment of the two cam carriers with respect to one another can be selected such that in a predetermined outset position, the motion reversal point of the needle or sinker cam control track, corresponding to the maximum needle projection and that corresponding to the lowermost drawing-off position, are located one above the other, such that the needles and the sinkers reach their corresponding motion reversal points at the same time. Beginning at this middle position, the needle and sinkler cam control tracks can then be displaced relative to one another in the manner already described.

With needles embodied as latch needles, the maximum needle motion or stroke may be selected to be equal to or shorter than the latch motion length of the needles. The maximum sinker motion or stroke is advantageously shorter than the maximum needle motion; for one entire quality range of goods, the maximum sinker motion or stroke is constant or in other words of equal length.

Because in the novel knitting machine the sinkers are located together with the needles in the needle cylinder or in a needle bed firmly connected thereto, the cam design is simpler and easier to service, highly compact, and as practical tests have shown leads to a considerable lessening of the danger of soiling of the guide slots of the needles and sinkers. It was furthermore found that the entire knitting machine is relatively resistant to fluctuating operating temperatures; that is, the weight of the goods produced per square meter hardly varies with the operating temperature of the machine. Since the loop forming process is essentially concluded within a range that encompasses only one needle division or cut (one needle and two sinkers), knots and slubs in the yarn cause almost no knitting problems, This is because a knot or slub in the yarn that is supplied is diverted over at most two needle hooks and a single sinker edge, before being finally knitted into the loop. As a result, as practical tests have shown, looser yarns and yarns of lower quality can also be worked without difficulty.

If as already explained the maximum needle motion or stroke when latch needles are used is equal to the latch motion length, or in other words the extent of the needle between its needle hook and the opened latch tip, then the excess stroke required for secure loop closure is performed by the sinkers, in that during the projection or yarn seizing motion of the needles the sinkers execute a retraction motion contrary to the needle projection.

Instead of latch needles, the novel knitting machine can is principle also use compound needles. In that case, only one additional cam track is necessary for controlling the needle sliders. The use of compound needles would have the advantage that the knitting machine, after a fabric cast-off or upon a new beginning of the knitting process can form loops without difficulty; in other words, in knitting machines equipped with latch needles the time-consuming opening of the latches, which must be performed by hand, can be dispensed with.

Finally, the novel knitting machine may be embodied as either a flatbed or circular knitting machine. One of its major advantages in either case is that it can use completely self-contained needle and sinker cam control tracks. As a result, the noise level and wear are reduced, while the operating speed of the machine is increased.

Various changes and modifications may be made and any features described herein may be used with any of the others, within the scope of the inventive concept.

I claim:

1. Knitting machine having a frame (6);

a needle bed (1, 3);

knitting needles (4, 5) located on the needle bed;

sinkers (22) which are short with respect to the needles located between the needle bed;

needle cam means (14) having a needle cam control track (20) operatively coupled to the needles to move the needles between a projected position and a withdrawn position and defining an upper needle motion reversal position (45) and a lower needle motion reversal position (46);

sinker cam means (12) having a sinker cam control track (33) operatively coupled to the sinkers to move the sinkers between a projected position and a withdrawn position and defining an upper sinker motion reversal position (49) and a lower sinker motion reversal position (48), said sinkers being additionally movable in a direction transverse to the longitudinal extent of the needle;

adjustment means (35) adjustably securing the sinker cam means (12) relative to the needle cam means (14) and securing the sinker cam means to the machine frame;

and wherein the needle cam control track (20) is positioned with respect to the sinker cam control track (33) such that a first range of movement of the needles (4) and sinkers (22) is controlled to move the needles in a direction downwardly towards the lowest withdrawn and needle reversal position (46) and counter to the direction of concurrent movement of the sinkers, and determining the length of loop stitches;

then, a second range of movement of the needles and sinkers is controlled from the position in which the needles (4) are at the lowest withdrawn, or needle movement reversal position (46) of the needle cam track and the sinker cam track has a portion which controls the sinkers for projecting movement;

a third range movement of the needles and the sinkers is controlled, in which the needles (4) and sinkers (22) move in the same direction, wherein, for said third range of movement, the needle cam control track (20), subsequent to said needle movement reversal position, a rising section which rising section has an essentially straight portion (58) and the sinker cam control track (33) has a rising section which has an essentially straight portion (55), which sinker cam control track (33) in the region of the essentially straight portion (55) thereof is essentially parallel to the essentially straight rising portion (58) of the needle cam control track (20);

wherein said adjustment means permit selective relative positioning of the needle cam means (14) and the sinker cam means (12) to position the needle cam control track (20) and the sinker cam control track (33) to place the lower needle reversal position (46) of the needle cam control track (20) to always remain in alignment with the essentially straight rising portion (55) of the sinker cam control track (33), and upon change of such selective relative positioning, maintaining intact said essentially parallel relationship of the essentially straight rising portions (58, 55) of the needle cam control track and the sinker cam control track; and wherein the essentially straight portions (58, 55) of the needle and sinker cam control tracks (22, 23) have projection angles (59, 54) which are essentially constant throughout essentially the respective essentially straight portions of said control tracks.

2. The knitting machine of claim 1, wherein at least one of the needle cam control track (20) and the sinker cam control track (33) is gently curved in the vicinity of at least one of the respective movement reversal positions (45, 46, 48, 49).

3. The knitting machine of claim 1, wherein the needles (4) are latch needles, and the maximum needle motion stroke or path (47) is equal to or shorter than the length of the latch motion.

4. The knitting machine of claim 1, wherein the needles (4) are latch needles; and wherein the maximum sinker motion stroke or path (50) is shorter than the length of the latch motion.

5. The knitting machine of claim 1, wherein the portions (58, 55) of the needle and sinker cam control tracks (20, 33) which are essentially straight and extend in the same direction, are dimensioned to extend over at least two needle cuts (56).

6. The knitting machine of claim 1, wherein at least one of: the needle, the sinker cam parts (60, 30), have loop or stitch forming cam parts that are adjustable in the needle longitudinal direction with respect to the respective cam carrier (14, 12).

7. The knitting machine of claim 1, wherein the upper sinker motion reversal position (49) of the sinker cam control track (33) is located within the range of the essentially straight rising portion (58) of the needle cam control track (20); and wherein the sinkers (22) with continued projection movement of the needles (4) execute a loop or stitch stripping-off motion.

8. The knitting machine of claim 7, wherein the upper needle motion reversal position (45) of the needle cam control track (20) and the lower sinker motion reversal position (48) of the sinker cam control track (33) are located one above the other such that the needles (4) and the sinkers (22) attain respective upper and lower motion reversal positions at the same time.

9. The knitting machine of claim 1, wherein (FIG. 2*a*) the sections (58, 55) of the needle and sinker cam control tracks (20, 33) are formed to be slightly convergent adjacent the upper motion reversal position (49) of the sinker cam control track (33).

10. The knitting machine of claim 9, wherein the convergence of the essentially straight portions (58, 55) of the needle cam control track and the sinker cam control track is adjustable.

11. The knitting machine of claim 1, wherein at least one of the needle and sinker cam control track (20, 33) is formed as a smooth track.

* * * * *